United States Patent [19]

Thompson

[11] Patent Number: 4,872,807

[45] Date of Patent: Oct. 10, 1989

[54] STATIC PRESSURE SYSTEM FOR GAS TURBINE ENGINES

[75] Inventor: Frank B. Thompson, North Palm Beach, Fla.

[73] Assignee: United Technologies Corporation, Hartford, Conn.

[21] Appl. No.: 279,633

[22] Filed: Dec. 5, 1988

[51] Int. Cl.[4] ..... F01D 17/08

[52] U.S. Cl. ..... 415/118; 137/15.2

[58] Field of Search ..... 415/17, 118; 60/39.07, 60/39.29, 204; 73/116, 117.3; 137/557, 15.1, 15.2

[56] References Cited

U.S. PATENT DOCUMENTS 2,989,846 6/1961 Hausammann ..... 137/15.2
4,123,196 10/1978 Prince, Jr. et al. ..... 137/15.2
4,291,533 9/1981 Dugger et al. ..... 137/15.2
4,414,807 11/1983 Kerr ..... 60/204
4,711,084 12/1987 Brockett ..... 60/39.29
4,733,975 3/1988 Komanetsky et al. ..... 415/118

*Primary Examiner*—Robert E. Garrett
*Assistant Examiner*—John T. Kwon
*Attorney, Agent, or Firm*—Norman Friedland

[57] ABSTRACT

A pressure sensing system strategically located measures static pressure of the inlet air of a gas turbine engine that is utilized as a signal indicative of engine inlet total pressure. The system consists of a number of ports circumferentially spaced around the engine case near the face of the engine which communicate with a manifold for feeding the average static pressure to a transducer.

3 Claims, 1 Drawing Sheet

STATIC PRESSURE SYSTEM FOR GAS TURBINE ENGINES

This invention was made under a Government contract and the Government has rights therein.

DESCRIPTION

TECHNICAL FIELD

This invention relates to gas turbine engines and particularly to means for obtaining a total pressure level by measuring static pressure.

BACKGROUND OF THE INVENTION

It is conventional practice to measure total pressure by utilizing a standard Pitot tube that is located within the flow stream of the pressure being measured. Because of their complexity, accuracy and reliability, Pitot tubes have not been widely utilized for on-board aircraft gas turbine engine sensors. While total pressure sensors are occasionally utilized for applications where there is an absence of total pressure distortions, these obviously are not used where pressure distortions are present. In a gas turbine engine inlet, where this invention is viable, the total pressure distortions preclude the use of total pressure sensors.

Another method of obtaining tool pressure is by inserting a probe in the flow stream and measuring the static pressure of that stream. This value can then be converted to the total pressure or to a close proximity thereto. Such a system is exemplified in U.S. Pat. No. 4,414,807 entitled "A Method and Apparatus for Controlling a Gas Turbine Engine" granted to W. B. Kerr on Nov. 15, 1982 and assigned to United Technologies Corporation, the assignee of this patent application. In this patented system the probe extends from the center of the engine's nose cone and extends axially forward approximately ½ engine diameter along the engine's axis. In this position, it is in the center of the air stream and a significant distance away from the engine's face. The measured static pressure is utilized as an input to certain controls for the engine and is converted to a usable parameter such as total pressure or engine pressure ratio and the like.

Obviously, a degree of complexity and hazard accompanies a sensor that includes a protruding probe. The probe, for example, disclosed in U.S. Pat. No. 4,414,870, supra, projects away from the front of the engine and precaution has to be taken to avoid breakage when the engine is being maintained or transported. Additionally, the probe is relatively expensive and adds to the overall weight of the engine.

I have found that I can obviate the problems enumerated above by providing a discrete number of static ports formed in the engine's case at a judicious location near the front of the engine. Locating the static ports at this particular location is contrary to heretofore practice and beliefs. It has heretofore been understood and assumed that the static pressure had to be measured some distance away from the front of the face of the engine so as to avoid the influence of engine suction and final air acceleration effects. However, in spite of these prior understandings, I have found that an accurate, reliable static pressure signal can be obtained by locating, and pneumatically averaging, a given number of static ports around the circumference of the face of the engine, as in the engine's casing, and located as proximate to the engine's face as possible. A system employing my invention has been tested under severe total pressure distortion conditions and has evidenced static pressure values well within the range of acceptability for use in a control system.

DISCLOSURE OF THE INVENTION

An object of this invention is to provide for an improved means for measuring static pressure in a gas turbine engine.

A feature of this invention is to dispose a number of static ports around the circumference of the inner wall of the engine case in proximity to the face of the engine, and the number being selected to provide a reliable average static pressure at this location.

A further feature of this invention is to cast an annular chamber in the wall of the engine case located in proximity to the engine's face and having static ports disposed around the circumference so that they communicate with the annular chamber. The static pressure of the chamber is then used as an indicator of engine face total pressure.

The foregoing and other features and advantages of the present invention will become more apparent from the following description and accompanying drawing.

BEST MODE FOR CARRYING OUT THE INVENTION

This invention is particularly efficacious in an aircraft engine where it is desirable of obtaining a value of total pressure without having to sense it. As was mentioned above, the structure in U.S. Pat. No. 4,414,807 essentially achieves this goal by utilizing an axially extending probe in the center of the flow stream being measured.

Figure 1:
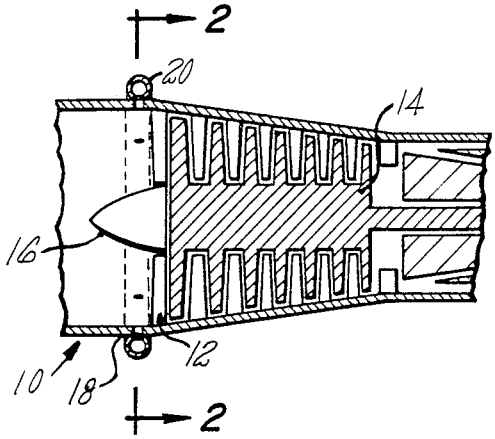
FIG. 1 is a partial view out of scale illustrating the invention mounted on the engine case and near the plane of the face of the engine.

By virtue of the present invention, the probe exemplified in the prior art is eliminated by utilizing static pressure ports located in the walls of the engine case and in the vicinity of the face of the engine. In the context of the present description, the face of the engine is defined as the plane extending in juxtaposition with the first set of vanes or in the event no inlet guide vanes are utilized, it will be the plane in juxtaposition with the first rotor of the engine. As shown in FIG. 1, the engine's inlet 10 consists of a duct for leading air into the engine. In this instance, the inlet guide vanes 12 are supported ahead of the compressor rotor 14 so that the air first sees the inlet guide vanes. In a typical engine installation a dome or spinner 16 extends forward to define an aerodynamic surface to smoothly lead engine inlet air into the engine.

Figure 2:
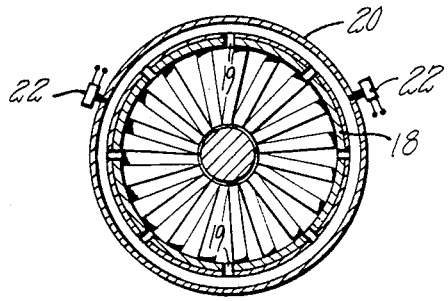
FIG. 2 is a view in section taken along lines 2—2 of FIG. 1 and likewise out of scale.

In accordance with this invention, as can be seen in FIG. 2, a plurality of ports 19, say 8, are evenly spaced around the circumference of the engine case 18 and allow the pneumatic static pressure signals to pass externally of the inlet 10 to a manifold 20 surrounding the engine case 18. One or more suitable pressure transducers 22 (two being shown) which can be any commercially available known types, serves to convert the static pressure signal to an electrical signal where it is then sent to the controller to be utilized as a parameter in a control system (not shown).

Obviously, the static pressure in manifold 20 will be the average pressure being supplied by the 8 ports. It will be noted that the ports are located as close to the engine face as possible, say 1 to 5 inches. The reason for this is to assure that a unique total-to-static pressure ratio is developed which does not change significantly even in the presence of severe inlet total pressure distortions that are occasioned by severe aircraft maneuvers, cross winds and the like. This unique total/static ratio exists due to the suction of the engine first rotor plus the acceleration of the air as it passes through the annulus created by the engine nose cone and the engine inlet case walls where the static ports are located. (See FIG. 1). These effects normalize, at the wall, any radial gradients in the total/static ratio that were present further upstream while the circumferentially manifolded ports (approximately 8) automatically sense an average static pressure which is directly related to the circumferential tool pressure profile present. Hence, both the pressure gradients in the radial and circumferential direction are normalized at the wall of the inlet, so that the variation in pressure exhibited in the gradient will not adversely influence the accuracy of the overall static pressure in the plane being measured. Therefore the average static pressure sensed is directly proportional to the true average total pressure. While eight (8) probes seem to be optimum, a greater or lesser number can be utilized depending on the installation and accuracy desired.

From actual tests, I have found that in the disclosed embodiment the relationship of the average total pressure to average static pressure changes less than three (3) percent with any type of engine inlet distortions. A sensor that exhibits this degree of accuracy falls well within the standards that allow its use for aircraft engine and fuel controls.

Figure 3:
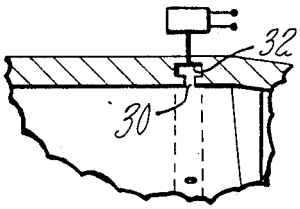
FIG. 3 is a partial view in section illustrating another embodiment of the invention.

In another embodiment as is exemplified in FIG. 3, the manifold may be cast in the wall of the engine casing. In this embodiment, ports 30 communicate with the cast manifold 32 in a similar manner as was disclosed in connection with FIGS. 1 and 2. Obviously, this eliminates the external manifold and its attendant connections and supports and reduced the size and weight of the installation.

While this invention shows in its preferred embodiment locating the ports close to the face of the engine, it is contemplated that the scope of this invention will also include embodiments that locate the ports in the sides of the inlet guide vanes 12 and/or directly in the engine nosecone 16. In either embodiment, the static pressure will be sensed around the circumference of the engine near the face of the engine, as opposed to an upstream location, but closer to the engine's centerline than is shown in the embodiment illustrated in FIGS. 1 and 2. In either embodiment, it is contemplated that a similar number of ports will be utilized to achieve the accuracy desired, but it is to be understood that the number of ports selected will be predicated on the particular application envisioned.

Although this invention has been shown and described with respect to detailed embodiments thereof, it will be understood by those skilled in the art that various changes in form and detail thereof may be made without departing from the spirit and scope of the claimed invention.

I claim:

1. For a gas turbine engine having a casing defining an inlet for leading air to said engine, a plane transverse to said inlet defining the upstream end of said engine, means for measuring the static pressure for obtaining a value of the total pressure of the airstream in said inlet that exhibits a value within a tolerance that is acceptable to be used in an engine control, said means including a plurality of ports circumferentially spaced in said casing located in proximity to said face for leading static pressure into a common manifold, and means for measuring the pneumatic pressure in said manifold for obtaining an average value of the static pressure of the air being admitted into said engine.

2. For a gas turbine engine as in claim 1 wherein said plurality of ports includes at least six (6) ports spaced around the circumference of said engine.

3. For a gas turbine engine as in claim 1 wherein said manifold is cast into said engine case.

* * * * *